US010000823B2

(12) United States Patent
Hartmann et al.

(10) Patent No.: US 10,000,823 B2
(45) Date of Patent: Jun. 19, 2018

(54) METHOD AND DEVICE FOR PARTIALLY HARDENING SHEET METAL COMPONENTS

(71) Applicant: voestalpine Metal Forming GmbH, Krems an der Donau (AT)

(72) Inventors: Dieter Hartmann, Mutlangen (DE); Roland Ziegler, Durlangen (DE); Tobias Hägele, Schwäbisch Gmünd (DE)

(73) Assignee: voestalpine Metal Forming GmbH, Krems an der Donau (AT)

( * ) Notice: Subject to any disclaimer, the term of this patent is extended or adjusted under 35 U.S.C. 154(b) by 699 days.

(21) Appl. No.: 14/365,310

(22) PCT Filed: Oct. 23, 2012

(86) PCT No.: PCT/EP2012/070911

§ 371 (c)(1),
(2) Date: Jun. 13, 2014

(87) PCT Pub. No.: WO2013/087274

PCT Pub. Date: Jun. 20, 2013

(65) Prior Publication Data

US 2014/0345757 A1 Nov. 27, 2014

(30) Foreign Application Priority Data

Dec. 14, 2011 (DE) ..... 10 2011 056 444

(51) Int. Cl.
*C21D 9/46* (2006.01)
*C21D 8/04* (2006.01)
(Continued)

(52) U.S. Cl.
CPC ..... *C21D 9/46* (2013.01); *C21D 1/673* (2013.01); *C21D 8/04* (2013.01); *C21D 8/0494* (2013.01);
(Continued)

(58) Field of Classification Search
CPC ..... C21D 9/46
See application file for complete search history.

(56) References Cited

U.S. PATENT DOCUMENTS 4,915,624 A 4/1990 Mittelstadt
6,524,404 B2 2/2003 Gehringhoff et al.
(Continued)

FOREIGN PATENT DOCUMENTS

AT 509596 A4 10/2011
DE 3738136 C1 1/1989
(Continued)

OTHER PUBLICATIONS

Markus Rattke and Joachim Natrop "Infrared Heating in Plastics Welding Technology," Joining Plastics www.joining-plastics.info, pp. 56-66, Jan. 2007.

*Primary Examiner* — Christopher Kessler

(57) ABSTRACT

The invention relates to a method for producing partially-hardened components from steel sheets, in which a component that is cold-formed from a hardenable steel sheet material is heated, in a furnace, to a temperature below the austenitization temperature ($<AC_3$), and a radiating element acts upon the component in sections where said component is to be austenitized ($<AC_3$), this radiating element having a component-side contour that corresponds to the contour of the component in the section to be austenitized. The invention also relates to a device for carrying out said method.

9 Claims, 3 Drawing Sheets

(51) Int. Cl.

| | |
|---|---|
| ***C21D 9/00*** | (2006.01) |
| ***C23C 2/02*** | (2006.01) |
| ***C21D 9/48*** | (2006.01) |
| ***C21D 1/673*** | (2006.01) |
| *C21D 1/34* | (2006.01) |
| *C22C 38/00* | (2006.01) |

(52) U.S. Cl.

CPC ..... *C21D 9/00* (2013.01); *C21D 9/0006* (2013.01); *C21D 9/48* (2013.01); *C23C 2/02* (2013.01); *C21D 1/34* (2013.01); *C21D 2221/00* (2013.01); *C22C 38/00* (2013.01)

(56) References Cited

U.S. PATENT DOCUMENTS

| | | | | |
|---|---|---|---|---|
| 7,357,060 | B2 | 4/2008 | Mueller et al. | |
| 7,540,993 | B2 | 6/2009 | Reinhold et al. | |
| 8,153,051 | B2 | 4/2012 | Vehof et al. | |
| 8,597,441 | B2 | 12/2013 | Sommer et al. | |
| 8,613,819 | B2 | 12/2013 | Vehof | |
| 2004/0060623 | A1 | 4/2004 | Boke et al. | |
| 2007/0163683 | A1 | 7/2007 | Schiessl | |
| 2009/0320968 | A1 | 12/2009 | Boeke et al. | |
| 2010/0300584 | A1 | 12/2010 | Buschsieweke et al. | |
| 2011/0240177 | A1 | 10/2011 | Eberlein | |
| 2012/0097298 | A1* | 4/2012 | Sommer | C21D 1/673 148/640 |
| 2012/0304448 | A1 | 12/2012 | Hartmann et al. | |
| 2014/0083572 | A1 | 3/2014 | Schwartz | |

FOREIGN PATENT DOCUMENTS

| | | | | |
|---|---|---|---|---|
| DE | 20014361 | U1 | 11/2000 | |
| DE | 10108926 | C1 | 1/2003 | |
| DE | 10208216 | C1 | 3/2003 | |
| DE | 10256621 | B3 | 4/2004 | |
| DE | 102004007071 | A1 | 9/2005 | |
| DE | 102004038626 | B3 | 2/2006 | |
| DE | 102005014298 | A1 | 10/2006 | |
| DE | 102006006910 | B3 | 5/2007 | |
| DE | 102005057742 | B3 | 6/2007 | |
| DE | 102006018406 | A1 | 9/2007 | |
| DE | 102007057855 | B3 | 10/2008 | |
| DE | 102007040746 | A1 | 3/2009 | |
| DE | 102008030279 | A1 | 1/2010 | |
| DE | 102008062270 | A1 | 6/2010 | |
| DE | 102008063985 | A1 | 7/2010 | |
| DE | 102009015013 | A1 | 11/2010 | |
| DE | 102009052210 | A1 | 7/2011 | |
| EP | 0816520 | B1 | 10/2001 | |
| EP | 2143808 | A1 | 1/2010 | |
| EP | 2169084 | A1 | 3/2010 | |
| EP | 1651789 | B1 | 8/2010 | |
| EP | 2497840 | A1 | 9/2012 | |
| WO | 2006/038868 | A1 | 4/2006 | |
| WO | 2010/089644 | A1 | 8/2010 | |
| WO | WO 2010109012 | A1 * | 9/2010 | C21D 1/673 |

* cited by examiner

Section A-A

METHOD AND DEVICE FOR PARTIALLY HARDENING SHEET METAL COMPONENTS

FIELD OF THE INVENTION

The invention relates to a method for partially hardening sheet metal components and a device for doing so.

BACKGROUND OF THE INVENTION

In recent years, the so-called press-hardening technology has gained ever-increasing importance in car body construction.

Initial developments of this press hardening process from the 1970s involved the heating of flat sheet metal blanks and the shaping and simultaneous cooling of heated sheet metal blanks in a single, cooled tool. In this connection, the sheet metal blank is heated to a temperature above the AC3 point and is thus partially or fully transformed into austenite. The quench hardening of the austenitic structure causes a martensitic hardening of the sheet metal component.

This press hardening method only became economically significant much later when it became necessary to produce vehicle bodies and in particular passenger compartments that were much more stable and rigid. The high levels of hardness that can be achieved with the press hardening method are advantageous in this regard.

In the course of further development, however, it has turned out that components that are consistently very hard, e.g. longitudinal beams, B pillars, cross members, etc. that demonstrate hardly any deforming behavior, are not ideal. Instead, it has since become necessary for particular regions of the component to be very hard while other regions are more ductile in order to permit a certain amount of deformation so as to prevent, for example, the component from fracturing.

It was also necessary not only to be able to manufacture such components without a coating, but also for them to be coated in a manner adapted in accordance with a corrosion protection coating of the entire body. In particular, it has become necessary to provide high-strength galvanized components. Basically, the press hardening method is divided into the so-called direct and indirect methods.

In the direct press hardening method, a flat blank is correspondingly heated to a temperature above the $Ac_3$ temperature of the respective steel compound, is kept there for a desired span of time, and is then shaped by means of a single shaping stroke in a tool and, because the tool is simultaneously cooled, is cooled and hardened with a cooling speed that is greater than the critical hardening speed.

In the indirect method, the blank has already been shaped into the finished component, then the finished component is heated to a temperature above the $Ac_3$ temperature of the respective steel compound, possibly kept at this temperature for a predetermined time, and then transferred to a corresponding forming tool, which likewise has the contour of the finished component, and once there, is cooled and hardened by this tool.

The advantage of the direct method is the relatively high cycle rates, but the single shaping stroke and the material behavior in the hot state make it possible to achieve only relatively simple component geometries.

The advantage of the indirect method is that it is possible to produce very complex components since the component itself can be shaped with any number of shaping strokes in the contour shaping appropriate to the manufacture of a normal body component. The disadvantage is a slightly lower cycle rate. But the indirect method has the advantage that a shaping step no longer occurs in the heated state, which is advantageous particularly with the use of metallic coatings because the metallic coatings are frequently in a partially liquid form at the high temperatures for the austenitization. In connection with the existing austenite, these liquid metallic coatings can result in a crack formation due to so-called "liquid metal embrittlement."

EP 1 651 789 B1, which belongs to the applicant, has disclosed a method for producing hardened components from sheet steel in which the shaped parts are cold-formed out of a sheet steel that is provided with a cathodic corrosion protection and then a heat treatment is carried out in order to achieve austenitization; a final trimming of the shaped part, required punching operations, and the production of a hole pattern are carried out before, during, or after the cold-forming of the shaped part; the cold forming, the final trimming, the punching, and the production of a hole pattern in the component are carried out in such a way that the shaped part is 0.5% to 2% smaller than the final hardened component so that trimming is no longer required in the hard state.

DE 10 2004 038 626 B3 has disclosed a method for producing hardened components from sheet steel in which the shaped parts are formed out of a sheet steel and a required final trimming of the shaped part and possibly required punching procedures for producing the hole pattern are carried out before, during, or after the shaping of the shaped part; finally, at least some regions of the shaped part are heated to a temperature that permits the steel material to austenitize and the component is then transferred to a form hardening tool and in the form hardening tool, a form hardening is carried out in which the component is cooled and thus hardened by the fact that the form hardening tool contacts and presses against the component, at least in some regions; the component is supported by the form hardening tool in the region of the positive radii and in at least some regions and in the region of the trimming edges, is held in a clamping, distortion-free fashion; in the regions in which component is not clamped, the component is spaced apart from at least one of the forming tool halves, leaving a gap between them.

DE 10 2005 057 742 B3 has disclosed a method for heating steel components in which the steel components to be heated are conveyed through a furnace and in the furnace, are heated to a predetermined temperature; a transport apparatus for transporting the components through the furnace is provided; a first transport device takes up the components in a precisely positioned fashion transports them through the furnace to heat them and after the heating, a second transport device takes the parts from the first transport device at a predetermined transfer point or transfer region and then conveys them out of the furnace at an increased speed and in a precisely positioned fashion, delivers them to another transfer point for further processing; the cited patent has also disclosed a device for heating steel components.

DE 10 2008 063 985 A1 has disclosed a method for producing a hardened sheet metal component from a sheet steel in which a sheet steel blank or a preformed or completely formed sheet steel component is heated to a temperature required for hardening and is then inserted into a tool in which the blank or the sheet steel component is hardened. In order to produce areas with less hardening or without hardening, the tool has recesses that are flushed with gas in this region; this gas flushing is carried out so that in these regions, gas cushions are produced whose presence reduces or prevents a cooling at a speed greater than the critical hardening speed; the cited patent has also disclosed a device for carrying out the method.

WO 2006/038868 A1 has disclosed a press hardening method in which a blank is formed and cooled in a cooled tool and in which the tool is used as a fixing device during the hardening. To this end, the tool has alternating contact surfaces and recesses that press against the shaped product in a particular region; the contact regions make up less than 20% of the total surface area. As a result, this region should be a soft zone of the final product and should nevertheless have a good dimensional accuracy.

DE 10 2007 057 855 B3 has disclosed a method in which a blank produced from a coated, high-strength boron steel is homogeneously heated to a temperature of approximately 803° C. to 950° C. in a furnace having several temperature zones and is kept at this temperature level for a certain amount of time. Then a first-type region of the blank is cooled to a temperature of approximately 550° C. to 700° C. in a second zone of the furnace and is kept at this reduced temperature level for a certain amount of time. At the same time, a second-type region of the blank is kept at a temperature level of approximately 830° C. to 950° C. in a third zone of the furnace for a certain amount of time. After this heat treatment, the blank is shaped into a shaped component in a hot-forming process. In this case, the component should be embodied with an aluminum/silicon coating; in the way described above, the first-type regions and second-type regions of the shaped part should have different ductility properties.

DE 10 2006 006 910 B3 has disclosed a body frame structure or running gear structure that is composed of steel structural components in which at least the load-bearing steel structural components should have zinc plate coatings that function as a corrosion protection coating.

DE 10 2004 007 071 A1 has disclosed a method for producing a component by shaping a coated blank that should be composed of a tempering steel; before the shaping, the blank is austenitized through a first heat treatment and should undergo a growth in layer thickness. The process should be optimized in that after a rapid cooling, the heat-treated blanks are temporarily stored; just before being shaped into the component, the blank undergoes a brief additional heating to the austenitization temperature and after the structural change has occurred, the shaping and hardening of the blanks should take place. The heating should preferably take place by means of induction.

DE 10 2005 014 298 A1 has disclosed an armoring for a vehicle; the armoring is produced by means of hot forming and press hardening; the intent of this is to enable the production of complex armors with a matching contour to be produced with a small number of welding seams.

DE 10 2009 052 210 A1 has disclosed a method for producing components out of sheet steel with regions of different ductility; either a sheet metal blank made of a hardenable steel alloy is used to produce a component by means of deep drawing and the deep-drawn component is then at least partially austenitized through a heat treatment and then quench-hardened in a tool or the blank is at least partially austenitized through a heat treatment and formed in a hot state and in the course of this or subsequently, is quench hardened; the sheet metal blank has a zinc-based cathodic corrosion protection coating; in regions of a desired higher ductility of the component, at least one other sheet is placed onto the blank so that during the heat treatment, the blank is heated to a lesser degree there than in the remaining region.

DE 10 2006 018 406 A1 has disclosed a method for heating work pieces, in particular components provided for press hardening; the work piece is supplied with heat for a period of time in order to heat it to a predetermined temperature, then during the heating, heat is conveyed away from a selected section of the work piece so that the temperature reached in the selected section during the heating period lies below the predetermined temperature. For example, the predetermined temperature is the temperature required for an austenite structure to form during the press hardening. In this case, the work piece is placed in a continuous furnace for heating and rests with selected sections against a respective body. The bodies are components of a tool mount—not otherwise shown—that can be moved into and out of the continuous furnace. The work piece can also be a preformed sheet metal component. The heat-absorption capacity of the bodies resting against the sections of the work piece is dimensioned so that up to the end of the heating time, the temperature of these bodies only reaches a value below the above-mentioned temperature threshold so that during the heating of the work piece, heat partially flows into the bodies. Before the mount is reused, the bodies cool down to a predetermined starting temperature or are cooled by means of a coolant.

DE 200 14 361 U1 has disclosed a B pillar for a body component, which is composed of a longitudinal profile made of steel; the longitudinal profile has a first longitudinal section with a predominantly martensitic material structure and a second longitudinal section with a higher ductility and a predominantly ferritic material structure; the different structures are produced so that during the heating of the component or blank, a protective or insulating body covers the region that should not be heated as intensely.

DE 10 2009 015 013 A1 has disclosed a method for producing partially hardened steel components in which a blank composed of a hardenable sheet steel is subjected to a temperature increase sufficient for a quench hardening and after reaching a desired temperature and possibly after a desired sojourn time, the blank is transferred into a forming tool in which the blank is shaped into a component and is simultaneously quenched or else the blank is cold formed and the component produced by the cold forming is then subjected to a temperature increase; the temperature increase is carried out so that a temperature of the component is reached which is required for a quench hardening and the component is then transferred to a tool in which the heated component is cooled and thus quench hardened; during the heating of the blank and component to increase their temperatures to a temperature that is required for the hardening, one or more absorption masses rest against regions that are intended to have a lower hardness and/or high ductility; with regard to its size and thickness, its thermal conductivity, and its thermal capacity, each absorption mass is dimensioned so that the thermal energy acting on the component in the region that remains ductile flows through the component into the absorption mass.

DE 10 2008 062 270 A1 has disclosed a device and corresponding method for partially hardening a metallic work piece; a conveying device transports the work piece in a conveying direction in a continuous furnace and is partially heated by means of a heating device; the heating device produces at least one heating zone that is moved in the conveying direction along with the work piece. In this way, the heating zone provided by the heating device can travel along with the work piece being continuously moved in the conveying direction so that only the section situated in the heating zone, but not the sections of the work piece situated outside the heating zone can be heated to a predetermined temperature, for example to the so-called austenitization temperature of steel.

DE 10 2008 030 279 A1 has disclosed a hot-forming line, which is intended to enable production of a partially hardened steel component through the processing that is carried out in several successive stations. During the production of the partially hardened component, it is, among other things, homogeneously heated to a temperature $<AC_3$ in a heating station in order to then be conveyed under an infrared lamp station and in the latter, is heated to a temperature above $AC_3$ in only some regions. In this way, the steel component is only partially hardened in the subsequent cooling process.

The object of the invention is to create a method for producing a partially hardened steel component with which it is possible to heat and produce such components quickly, inexpensively, and with high precision.

Another object of the invention is to create a device for carrying out the method, which has a simplified design, permits a high throughput capacity, enables a precise partial heating, and is also energy efficient.

SUMMARY OF THE INVENTION

The inventors have recognized that the existing methods have disadvantages; in partial press hardening, absorption masses result in a higher energy demand since the absorption masses must be cooled after the passage through the furnace is completed in order to be reusable. With the partial heating of blanks, e.g. in a roller hearth furnace, there is no precise, reproducible delimitation of the transition regions from hard to soft so that this method is more suitable for continuous ductile regions.

The partial cooling in the press hardening tool results in increased cycle times due to longer sojourn times in the tool and dimensional stability problems due to the twisting of parts during the cooling and shrinking of the differently tempered regions. During the partial tempering to produce a ductile region, the additional process step increases the amount of time required.

The invention has successfully created a sequence for the press hardening of body components, which is neutral with regard to cycle time and has a low energy demand and with which in the rapid deformation that occurs in crash load situations, the stresses that occur during the crash are selectively distributed to and absorbed by the component in precisely defined subregions.

According to the invention, this is accomplished by taking a component that is essentially ready-shaped—and preferably, is completely ready-shaped—and heating it in a continuous furnace to approx. 700° C. in order to produce a zinc/iron layer. After the component temperature of approx. 700° C. is reached, the component is cyclically moved under three-dimensionally contoured radiating elements and, depending of the complexity of the contour, is lifted in the region of this three-dimensionally contoured radiating element so that the radiating element, in the region that is to be heated further, is preferably spaced approximately the same distance apart from all areas of the surface. The component is austenitized by the radiating element in this region and in particular, is heated to a temperature that is above the $Ac_3$ point, and in particular, is heated to 910° C. and above, but the remaining regions are not subjected to the radiation and thus remain below the austenitization temperature.

After the heating, the components are form-hardened in a corresponding tool, i.e. without significant shape changes, just being cooled quickly. The component regions that the three-dimensionally contoured radiating elements have heated to the austenitization temperature and in particular to a temperature greater than 900° C. are thus transformed into a martensitic structure and reach tensile strengths of about 1300 MPa.

The regions that are kept below the austenitization temperature at about 700° C. cannot transform into a martensitic structure and reach the desired tensile strength of between 450 MPa and 700 MPa.

The use of three-dimensionally contoured radiating elements that act on only some regions of a blank requires a cyclical and precisely positioned passage of components through the furnace. For example, a component is transported further in the furnace, from station to station, in a precisely positioned fashion every 15 seconds. For a precisely positioned transport, the components are preferably placed onto appropriate component supports; the component supports are adapted to the component so as to permit a robot to place the component onto the support in a precisely positioned fashion and the component stays in exactly this position on the component support.

The furnace temperature is between 650° C. and 800° C., preferably between 700° C. and 750° C.

The component is moved in the furnace until it reaches a region that corresponds to a sojourn time in the furnace such that the component has reached the desired temperature and in particular, has reached the desired temperature of 700° C. Then the component travels into a region of the furnace in which the three-dimensionally contoured radiating elements are mounted at certain intervals. The component then remains under the respective three-dimensionally contoured radiating element for a cycle time of for example 15 seconds in order for subregions of the component to be further heated to 900° C.; as before, the temperature of the rest of the furnace remains between 650° C. and 800° C., preferably between 700° C. and 750° C., preferably 730° C.

This comparatively low furnace temperature enables a very large processing window, even in the event of interruptions since an overheating of the components is ruled out by a possible rapid switching off of the three-dimensionally contoured radiating elements and the low furnace temperature.

In order to achieve a high definition for the edge regions in which the three-dimensionally contoured radiating element acts on the component, i.e. the regions between the high component temperature of greater than 900° C. and the low component temperature, namely 700° C., the component supports with which the component is transported through the furnace can be provided in an intrinsically known way with absorption masses, i.e. for example a frame around the desired harder region, with the thermal conductivity, the thermal capacity, and the emissivity of the material being appropriately matched. In these regions, the thermal energy that should not flow from the hotter region into the colder region is then conveyed through the component and into the absorption mass, thus achieving a different structure of the component with a very high degree of edge definition.

With the invention, it is advantageous in this connection that the absorption masses do not have to be cooled on the return path of the supports and the absorption masses that have been heated to approx. 700° C. can be used, when the components are placed onto them, to already preheat the components for the 700° C. temperature that is desired in this region. This even goes so far that the return path of the supports in the furnace extends through a likewise hot region situated beneath the furnace so that the release of energy due to the mass being conveyed out of the furnace is kept to a minimum.

The components can be lifted by means of their supports when they have reached the cycle position of a three-dimensionally contoured radiating element so that they are close to the radiating element. The corresponding three-dimensionally contoured radiating element can, however, also be moved toward the component. The heating of the component in this case can be produced by means of a single radiating element or can occur in cyclical fashion by means of a plurality of radiating elements arranged one after another.

After the component is heated in the above-mentioned region, the component, which now has the desired temperature profile, is conveyed out of the furnace by a manipulation tool and transferred to a form hardening tool.

Naturally instead of a component, it is also possible to act with temperature on a flat blank or a flat region of a component by means of a radiating element of this kind; in this case, the radiating element is embodied as flat, but nothing in the method sequence is changed; in a flat region that then has the desired temperature profile, an additional shaping and not just a pure form hardening can then be carried out.

The three-dimensionally contoured radiating elements or the radiating elements that are embodied as flat can in this case be heated electrically or by means of gas; with a heating by means of gas, it is advantageous to encapsulate this gas heating so that the component and the furnace atmosphere are not acted on with exhaust gases in order to prevent a hydrogen penetration and a hydrogen embrittlement of the material.

The invention also includes heating elements that are not embodied in the form of radiating elements, but should the need arise, carry out an induction heating in this area; an appropriate three-dimensional embodiment is nevertheless ensured in order to guarantee a uniform heating in this area.

BRIEF DESCRIPTION OF THE DRAWINGS

The invention will be explained by way of example below in conjunction with the drawings. In the drawings.

DETAILED DESCRIPTION OF THE PREFERRED EMBODIMENTS

Figure 1:
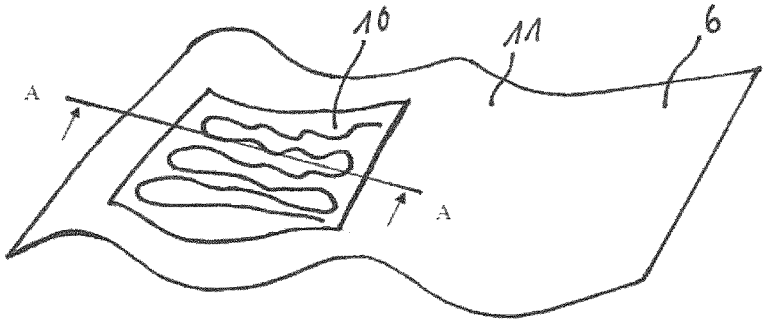
FIG. 1: is a very schematic depiction of a component with a heated region.

The device according to the invention (FIGS. 1 through 3) has at least one elongated continuous furnace 1 (FIG. 3) with a furnace chamber 2, through which it is possible to travel along a conveying direction. For this purpose, a conveying device that is not shown in detail can be provided in an underfloor region 4 and supports 5 for components 6 can be conveyed thereon. The supports 5 in this case are fastened to the conveying device so that they can be conveyed along a longitudinally oriented opening or slot that connects the underfloor region 4 to the furnace chamber 2. In an intrinsically know fashion, the furnace chamber contains, for example, gas-heated furnace radiating tubes 7 that emit heat into the furnace chamber 2. The components 6 are arranged on the supports 5 and are heated by the furnace radiating tubes 7.

The furnace chamber 2 in this case is divided into two regions; the division does not have to be three-dimensional, for example with a dividing wall. A first region I serves to heat the components to approx. 700° C. and therefore is equipped with furnace radiating tubes 7. The second region II is also equipped with furnace radiating tubes 7.

In addition to the furnace radiating tubes 7, this region also contains the three-dimensionally contoured radiating elements 8. The three-dimensionally contoured radiating elements 8 in this case can, for example, be lowered onto the components 6 from a furnace ceiling 9 by means of appropriate mechanisms. The components in this case are conveyed through on the supports 5 so that every 15 seconds, for example, they are conveyed farther and then stopped, likewise for 15 seconds, for example.

Figure 3:
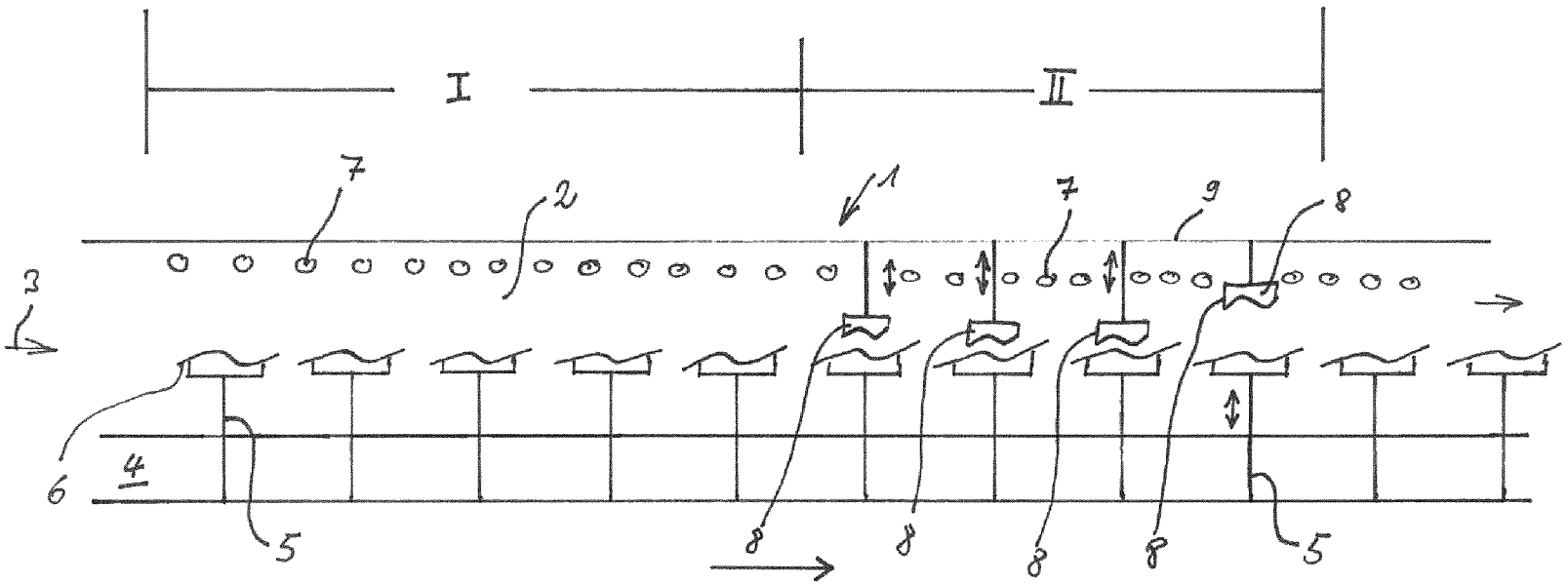
FIG. 3: is a very schematic longitudinal section through a furnace according to the invention.

In addition, it is also possible to design a support 5 so that it can be raised and lowered, as is the case for the supports on the far right in FIG. 3; in this case, the three-dimensionally contoured radiating element is for example affixed to a furnace ceiling in a stationary fashion. After the departure from the furnace, a correspondingly heated component can be moved by a manipulator into an appropriate forming tool or form hardening tool.

A corresponding component can be seen in FIG. 1, which shows a heated region.

Figure 2:
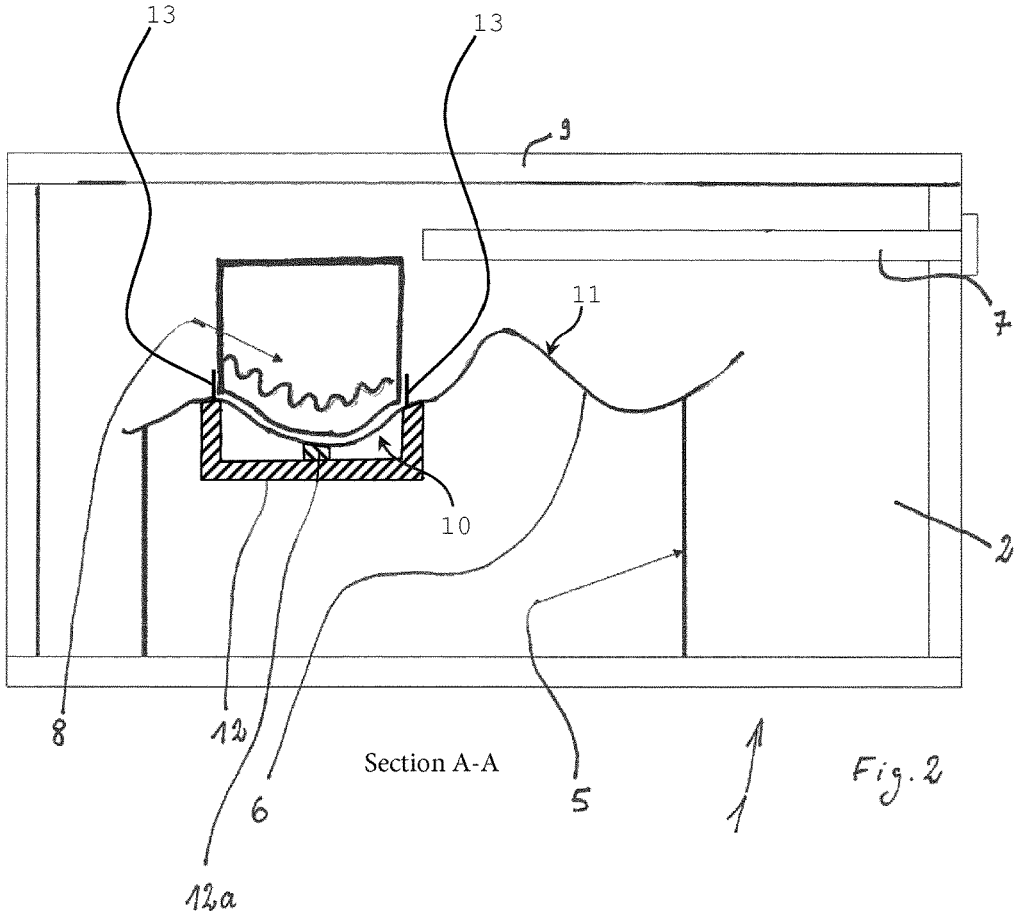
FIG. 2: is a cross section through a furnace for carrying out the method.

FIG. 2 shows the radiating element that has been lowered onto the component and is preferably spaced approximately the same distance apart from the surface of the work piece 6 in all regions so that a uniform heating is possible. In order to embody the temperature progression between the heated region 10 and the surrounding warmed region 11 in as sharply defined a manner as possible, corresponding absorption masses or an appropriately frame-shaped absorption mass 12 can be provided in the boundary region between the area heated by the three-dimensionally contoured radiating element 8 and the surrounding areas. The absorption mass in this case ensures that no heat or as little heat as possible is transmitted from the region 10 heated by the radiating element 8 into the remaining region 11 and into the furnace chamber. In this case, in regions that are within the heated region and should remain ductile, for example in the vicinity of a hole 12*a* that is to be subsequently punched, the absorption mass 12 can also have an absorption mass so that this region remains ductile.

The complete sequence of the method according to the invention is as follows:

A blank is stamped out of a steel band composed of an austenitizable steel, for example a 22MnB5 steel or a comparable steel that can be hardened through quench hardening. The stamped blank is then deep drawn into a component using a conventional shaping process; this component can already have the three-dimensional final contour of the desired component or else certain thermal expansions or expansions due to changes in the structure can be taken into account such that after a quench hardening step, which nevertheless occurs without significant further shaping, the component has the desired final contour and final size.

This component is in particular a component provided with a zinc coating or a zinc-based coating.

These components are placed onto furnace supports by a manipulation tool in a first transfer station. For this purpose, the components can have corresponding holes that are engaged by pick-up pins or bolts of the support. In this connection, it is important for the method that the component is placed onto the support in an absolutely precisely positioned fashion, with an absolutely uniquely defined position of the component. Then the support travels into the furnace; in the furnace, the component on the support first travels through a first region in which the furnace temperature is between 650° C. and 800° C., in particular between 700° C. and 750° C., preferably 730° C.; this temperature is achieved by means of furnace radiating tubes. The length of the furnace or of the first furnace section in this case is dimensioned so that at the end of this section, the components have a temperature of 700° C. to 750° C., preferably 730° C.

In this case, the components are conveyed through the furnace in a cyclical fashion. This means that a furnace support is transported by a respectively fixed distance from station to station and then in this station, in whose position it is precisely kept, is stopped for a certain amount of time, for example 15 seconds, before the furnace support together with the component is advanced exactly to the next station and remains in it in turn for a holding time. After the furnace section I, the support together with the component travels into the furnace section II, in which a three-dimensionally contoured radiating element is situated above all or part of the cycle stations. After the arrival at the station, either the three-dimensionally contoured radiating element is lowered onto the component or the component is raised and positioned with a predetermined, always equal distance from the component; in the region covered by the radiating element, the component is acted on with thermal radiation in such a way that either by means of a single radiating element or by means of a plurality of radiating elements arranged one after the other in the cycle sequence, a sufficient amount of thermal energy is imparted to the component such that this region is heated at least to the austenitization temperature ($>Ac_3$).

In order to embody the definition between the heated region and unheated region as sharply as possible, the furnace support can have an absorption mass that is embodied, for example, in the form of a frame around the heated region and comes to rest against the component from the side opposite from the radiating element. As explained above, thermal energy that tends to flow from the heated region into the cooler region can thus be conveyed into the absorption mass.

After the component has been sufficiently heated even in the heated region, then the component is cyclically transported out of the furnace and is immediately picked up by a manipulation tool and transferred to a form hardening tool. In the form hardening tool, the form hardening tool surfaces of the form hardening tool rest against the component and cool it rapidly. The cooling in at least the regions that are heated (by the three-dimensionally contoured radiating elements) occurs at a speed greater than the critical hardening speed of the respective steel material so that the initially austenitic phase is essentially transformed into martensite and as a result, achieves a high degree of hardness.

The support, possibly provided with the absorption masses, travels—for example driven by a conveyor chain—through the furnace and after exiting from the furnace, for example underneath the furnace, travels—either in an encapsulated underfloor region or in a manner that provides open air cooling—back to the transfer station (at the beginning of the furnace).

Since according to the invention, both the support and the absorption masses do not intrinsically require cooling, it is suitable for the support, possibly together with the absorption mass, to be conveyed back in an encapsulated region so that the support and the absorption mass do not need to be heated again in the furnace, but instead, the already warm absorption masses can additionally feed thermal energy into the component. A cooling, however, is likewise possible.

With the invention, it is advantageous that such a device can be implemented at a comparatively low cost; the control-related costs are also low.

It is also advantageous that with the method, less heat is discharged from the furnace than with conventional methods, making it more energy efficient and thus less expensive.

In addition, the three-dimensionally contoured radiating elements make it possible to meter the heat into the components in a very precise fashion so that the results can be reproducibly achieved with a high degree of uniformity.

With flat sheet metal parts that are to undergo a subsequent shaping in the hot state or when it is only necessary to act on flat regions of an otherwise contoured component, the three-dimensionally contoured radiating elements can naturally also be embodied as only two-dimensional.

REFERENCE NUMERAL LIST

1 continuous furnace
2 furnace chamber
3 conveying direction
4 underfloor region
5 support
6 component
7 furnace radiating tubes
8 three-dimensionally contoured radiating element
9 furnace ceiling
10 heated region
11 warmed region
12 absorption mass
12*a* hole to be punched
I first region
II second region

The invention claimed is:

1. A method for producing partially hardened components out of sheet steel, comprising:

heating a component that is cold formed out of a hardenable sheet steel in a furnace to a temperature below an austenitization temperature ($<Ac_3$); and acting on the component with a radiating element in regions in which the component should be austenitized ($>Ac_3$);

wherein the radiating element has a three-dimensional contour on a side oriented toward the component, which approximately corresponds to a contour of the component in the region to be austenitized.

2. The method according to claim 1, wherein in a working position, the radiating element is spaced the same distance apart from the surface of the component over the entire area that is to be heated and austenitized.

3. The method according to claim 1, comprising heating the radiating element electrically or with gas and in such a way that the surface of the radiating element oriented toward the component has a uniform temperature and radiation intensity.

4. The method according to claim 1, comprising placing the component on a support and conveying the component through the furnace in a precisely positioned, cyclical fashion.

5. The method according to claim 1, comprising, for action with thermal radiation, raising supports, lowering the radiating elements, lowering the supports, or raising the radiating element, depending on the way in which the support is conveyed through the furnace, and as a result, bringing the component to a desired distance from the radiating element.

6. The method according to claim 1, comprising situating a plurality of radiating elements in the furnace, one after another in the conveying direction, and performing the heating action with a plurality of radiating elements in steps in accordance with a work cycle.

7. The method according to claim 1, comprising, in order to increase a definition between austenitized and non-austenitized regions on a support, positioning an absorption mass on the support; the absorption mass rests against the component in the austenitized region and in the non-austenitized region and acts on the component so that thermal energy that could flow from the austenitized region to the non-austenitized region is absorbed by the absorption mass.

8. The method according to claim 7, wherein additional absorption masses act in regions that should remain ductile within the austenitized region, particularly in regions in which holes are to be subsequently punched.

9. The method according to claim 1, comprising transferring each of the components to a respective support in a precisely positioned and located fashion, conveying each of the components through the furnace along with a support, and at the end of the furnace, taking each of the components from the support in a precisely positioned and located fashion by a manipulator in a second transfer position, and transferring each of the components to a form-hardening tool and cooling the components therein; wherein the cooling of the components takes place at a speed that is greater than a critical hardening speed of a base material of the components in such a way that the austenitized regions undergo a martensitic hardening.

* * * * *